US007431593B2

(12) United States Patent
Hunter et al.

(10) Patent No.: US 7,431,593 B2
(45) Date of Patent: Oct. 7, 2008

(54) ADSL WIRE BONDING AND GROUNDING CLAMP

(75) Inventors: Dewey Hunter, Austell, GA (US); Scott Yapp, Roswell, GA (US); Angelica Cisneros, San Nicolas de los Garza (MX)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/708,953

(22) Filed: Feb. 21, 2007

(65) Prior Publication Data

US 2008/0096403 A1 Apr. 24, 2008

Related U.S. Application Data

(60) Provisional application No. 60/775,870, filed on Feb. 23, 2006, provisional application No. 60/853,599, filed on Oct. 23, 2006.

(51) Int. Cl.
*H01R 4/66* (2006.01)

(52) U.S. Cl. ..... 439/98

(58) Field of Classification Search ..... 439/98, 439/100, 92, 99

See application file for complete search history.

(56) References Cited

U.S. PATENT DOCUMENTS

| | | | | |
|---|---|---|---|---|
| 2,279,866 | A * | 4/1942 | Ellinwood | 174/40 CC |
| 2,423,627 | A * | 7/1947 | Tinnerman | 439/100 |
| 2,423,492 | A * | 12/1947 | Tinnerman | 174/40 CC |
| 3,253,247 | A | 5/1966 | Vos | |
| 3,787,797 | A | 1/1974 | Kurz | |
| 3,798,585 | A | 3/1974 | Thompson et al. | |
| 3,915,540 | A | 10/1975 | Thompson et al. | |
| 3,963,299 | A | 6/1976 | Thompson et al. | |
| 4,026,619 | A | 5/1977 | Gillemot | |
| 4,036,546 | A | 7/1977 | Thompson et al. | |
| 4,325,598 | A | 4/1982 | Leonardo | |
| 4,353,612 | A | 10/1982 | Meyers | |
| 4,561,708 | A | 12/1985 | Sorlien et al. | |
| 4,571,013 | A | 2/1986 | Suffi et al. | |
| 5,131,856 | A * | 7/1992 | Auclair | 439/100 |
| 5,616,036 | A * | 4/1997 | Polidori | 439/100 |
| 5,722,840 | A | 3/1998 | Auclair et al. | |
| 6,101,712 | A * | 8/2000 | Wright | 29/863 |
| 6,297,447 | B1 * | 10/2001 | Burnett et al. | 174/40 CC |
| 6,322,378 | B1 | 11/2001 | Auclair | |
| 6,482,028 | B2 * | 11/2002 | Kumamoto et al. | 439/498 |
| 6,595,789 | B2 * | 7/2003 | Oota et al. | 439/98 |

(Continued)

*Primary Examiner*—Tulsidas C. Patel
*Assistant Examiner*—Vladimir Imas
(74) *Attorney, Agent, or Firm*—Hoffmann & Baron, LLP

(57) ABSTRACT

A cable bonding and grounding clamp that includes: a closed end having a first side and a second side; a pair of side walls each having a first section connected to a second section by an offset section; an open end formed by the second sections; an aperture in at least one of the first sections for viewing a cable positioned between the first sections; and an opening in each of the second sections for receiving a fastening device. Another embodiment is a cable bonding and grounding clamp assembly for a cable having one or more pairs of wires and a grounding shield. The assembly includes an annular member and a clamp. The annular member is installed between the grounding shield and the one or more pairs of wire and the clamp is then installed over the grounding shield and the annular member and tightened with a fastening device.

9 Claims, 14 Drawing Sheets

U.S. PATENT DOCUMENTS 6,616,463 B1 * 9/2003 Burnett et al. ..... 439/610
6,669,511 B1 * 12/2003 Yagi et al. ..... 439/610
6,702,596 B2 3/2004 Auclair
6,815,610 B2 * 11/2004 Kuboshima et al. ..... 174/360
6,991,493 B2 * 1/2006 Matsui et al. ..... 439/579
2002/0058430 A1 * 5/2002 Daume ..... 439/100
2002/0106918 A1 * 8/2002 Saito et al. ..... 439/98
2005/0112921 A1 * 5/2005 Lin et al. ..... 439/98
2005/0266707 A1 * 12/2005 Franks, Jr. ..... 439/92
2006/0121771 A1 * 6/2006 Machado et al. ..... 439/395

* cited by examiner

ADSL WIRE BONDING AND GROUNDING CLAMP

FIELD OF THE INVENTION

This application claims priority from provisional applications Ser. No. 60/775,870, filed on Feb. 23, 2006, and Ser. No. 60/853,599, filed on Oct. 23, 2006, both of which are incorporated herein in their entirety.

The present invention relates to a clamp for bonding and grounding the internal shield of a cable. In particular, the present invention relates to a clamp that bonds and grounds both the RF drain wire and the internal shield of a multi-pair cable.

BACKGROUND OF INVENTION

Asymmetric Digital Subscriber Line (ADSL) is a modem technology that uses a special ADSL modem to convert existing twisted-pair telephone lines into access paths for multimedia and high-speed data communications. ADSL allows more data to be sent over existing copper telephone lines (POTS) and can expand existing access capacity by a factor of 50 or more without new cabling. ADSL can transform a public information network from one limited to voice, text and low resolution graphics to a powerful system capable of carrying multimedia, including full motion video, to subscribers. ADSL allows telephone companies, and other service providers, to enter new markets for delivering information in video and multimedia formats to subscribers in areas where broadband cabling is not available. The increased data capacity provided by ADSL technology can be used to transmit movies, television, video catalogs, remote CD-ROMs, corporate LANs, and the Internet into homes and small businesses. The high capacity ADSL lines are sensitive to stray signals and require reliable and effective bonding and grounding in order to operate properly.

An ADSL circuit connects an ADSL modem on each end of a twisted-pair telephone line, creating three information channels: a high speed downstream channel, a medium speed duplex channel (depending on the implementation of the ADSL architecture), and a POTS (plain old telephone service) or an ISDN (integrated services digital network) channel. The POTS/ISDN channel is split off from the digital modem by filters, thus guaranteeing uninterrupted POTS/ISDN, even if the ADSL fails. Each channel can be submultiplexed to form multiple, lower rate channels, depending on the system.

The large amount of data transmitted by ADSL and the high transmission speeds requires the transmission lines to operate at maximum efficiency. Accordingly, the bonding and grounding of the RF drain wire and the internal shield of an ADSL multi-pair cable are critical. The prior art devices used for bonding and shielding the RF drain wire and internal shield in a cable have been found to be unsatisfactory for several reasons. For example, many prior art devices include a small triangular bullet style bond. These devices force the bond under the cable jacket where the bond is hidden from view and cannot be inspected. In addition, forcing the bond under the jacket can cause the shield to be pushed back into the jacket so that there is not sufficient metal-to-metal contact.

In addition, many of the prior art devices use a stranded daisy chain arrangement with pre-set eyelets which are either too bulky or too costly or have an oversized load capacity. These devices are not versatile due to their pre set holes, which limit the choices of location for securing the new bonded drop or bond. Moreover, the prior art devices are not tightly secured to the cable and can be easily pulled out of the cable jacket. Accordingly, there is a need for a bonding and grounding clamp that can be easily connected to multi-pair cables, such as ADSL cables, and provide reliable and effective bonding and grounding of the RF drain wire and the internal shield.

Another object of the present invention is to provide a grounding clamp for a shielded cable that does not damage the wires inside the cable when the clamp is secured to the cable. Grounding clamps for the shields of multiple conductor cables that are currently in use are installed over the cable and then tightened to secure the clamp in place and to provide good electrical contact between the clamp and the shield. However, installing the clamp around the cable can damage the wires if the clamp is tightened too much. This can split open the covers around the wires and cause them to come in contact with each other. In some cases, it can even result in one or more of the wires being crushed or severed. Accordingly, there is a need for a bonding and grounding clamp assembly that can be easily connected to multi-pair cables, such as ADSL cables, and provide reliable and effective bonding and grounding of the RF drain wire and the internal shield without damaging the wires.

SUMMARY OF THE INVENTION

In accordance with the present invention, a cable bonding and grounding clamp is provided that includes: a closed end having a first side and a second side; a pair of side walls each having a first section connected to a second section by an offset section; an open end formed by the second sections; an aperture in at least one of the first sections for viewing a cable positioned between the first sections; and an opening in each of the second sections for receiving a fastening device. The first sections extend from the first and second sides of the closed end and the second sections are offset inwardly from the first sections by the offset sections. The cable bonding and grounding clamps can include a fastening device, preferably, a threaded bolt or screw and a nut. The fastening device is tightened to secure the cable between the two first sections of the side walls and to electrically contact the two second sections.

Preferably, the first and second sections are substantially flat and substantially parallel to each other. The first sections of the side walls are separated by a first distance and the second sections of the side walls are separated by a second distance. Preferably, the first distance is from about 0.25 to about 4 times greater than the second distance. The first sections of the side walls form a clamp opening therebetween and a cable having a maximum cross-sectional dimension of up to about 3 inches can pass through the clamp opening. In addition, each of the first sections can have an aperture through which the cable and the grounding shield can be viewed. In preferred embodiments, the openings in the second sections are substantially aligned to allow the fastening device to be easily inserted through both openings.

In another embodiment, the cable bonding and grounding clamp includes: a closed end comprising a curved side wall and a pair of opposing ends; at least one aperture in the curved side wall for viewing a cable positioned therebetween; a pair of substantially flat sections extending from the pair of opposing ends; an open end formed by the pair of substantially flat sections; and an opening in each of the substantially flat sections for receiving a fastening device. Preferably, the openings in the pair of substantially flat sections are substantially aligned. The fastening device, preferably a threaded bolt or screw and a nut, is tightened to secure the cable within the curved side wall and to electrically contact the pair of substantially flat sections. The curved side wall forms a clamp opening having a diameter of from about 0.125 inch to about 3.0 inches.

The dimensions of the cable bonding and grounding clamp can be varied to accommodate cables of different sizes and shapes. The preferred shape of the clamp is intended to maximize the area of contact between the clamp and the cable shield. Preferably, the clamps and the fastening devices are made from an electrically conductive metal.

Another embodiment of the invention is directed to a cable bonding and grounding clamp assembly for a cable having one or more pairs of wires and a grounding shield. The assembly includes an annular member and a clamp. The annular member includes: a cylindrical body having a longitudinal axis, a diameter, an exterior wall and an annular opening; a substantially flat leg extending from the exterior wall; and an opening in the substantially flat leg. The clamp includes: a closed end having a curved side wall with opposing ends; a pair of substantially flat members extending from the opposing ends of the curved side wall; an open end formed by the pair of substantially flat members; and a pair of apertures in the pair of substantially flat members. The annular member is installed between the grounding shield and the one or more pairs of wire and the clamp is then installed over the grounding shield and the annular member so that the opening in the substantially flat leg corresponds to the apertures in the pair of substantially flat members. Preferably, the curved side wall of the clamp corresponds to the exterior wall of the cylindrical body.

The cable bonding and grounding clamp assembly can also include a fastening device, preferably, a threaded bolt or screw and a nut. After the clamp is installed over the annular member, a fastening device can be passed through the opening in the substantially flat leg and the apertures in the pair of substantially flat members. The fastening device is then tightened to electrically contact the annular member and the clamp with the grounding shield. The diameter of the annular opening in the annular member can be from about 0.125 inch to about 3 inches. preferably, the annular member, the clamp and the fastening device are made from an electrically conductive metal.

The dimensions of the cable bonding and grounding clamp assembly can be varied to accommodate cables of different sizes and shapes. The preferred shape of the annular member and the clamp are substantially curved or cylindrical to maximize the area of contact between the clamp and the cable shield.

BRIEF DESCRIPTION OF THE FIGURES

The preferred embodiments of the cable bonding and grounding clamp of the present invention, as well as other objects, features and advantages of this invention, will be apparent from the following detailed description, which is to be read in conjunction with the accompanying drawings wherein.

DETAILED DESCRIPTION OF THE INVENTION

Figure 1:
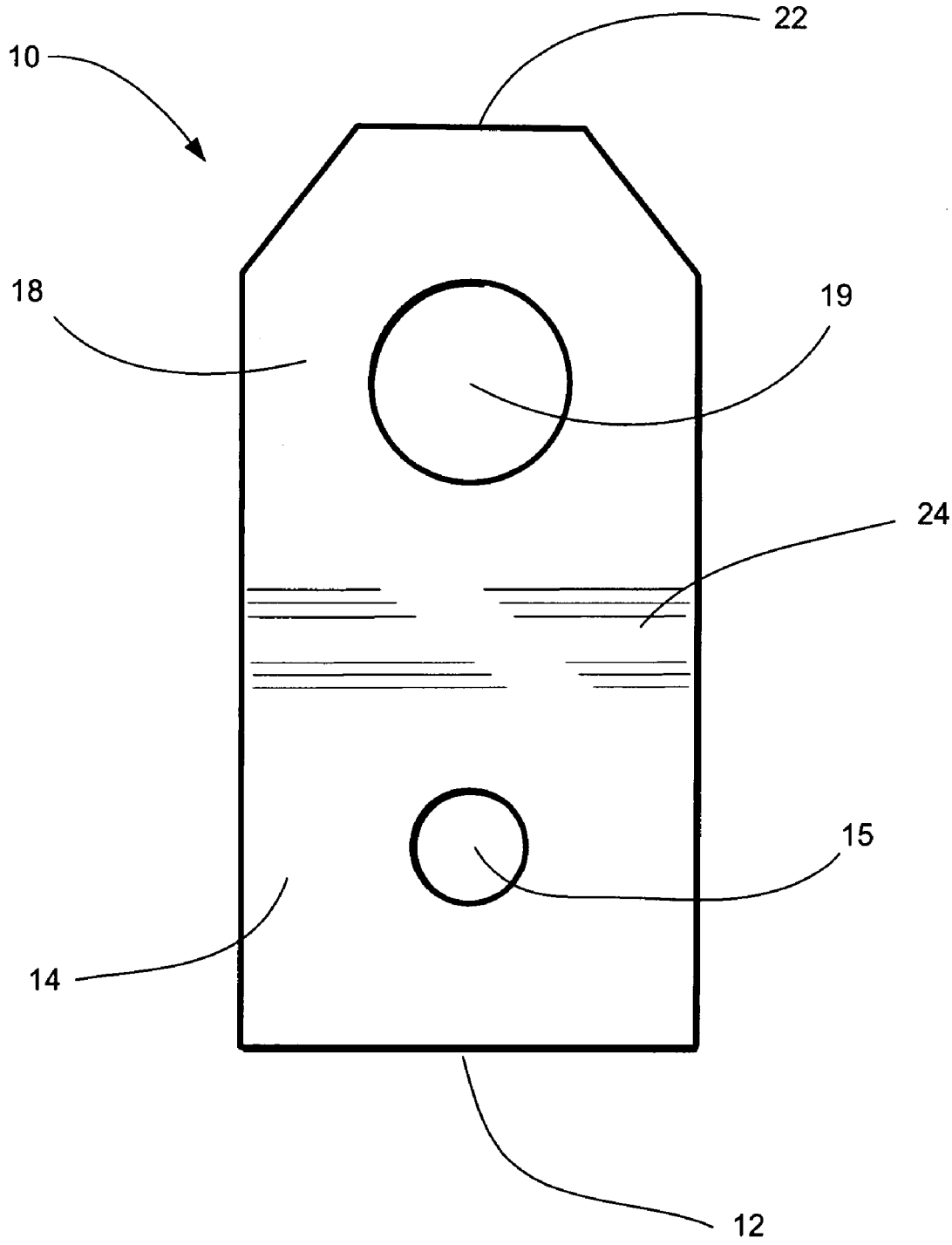
FIG. 1 is a front view of a first embodiment of the bonding and grounding clamp.

The first embodiment of the present invention is a clamp for bonding and grounding a shielded cable, preferably, a shielded multi-conductor cable having an RF (radio frequency) drain wire and, most preferably, a shielded three-pair cable having an RF drain wire. The clamp provides a mechanism for bonding both an RF drain wire as well as the internal shield of the cable to a ground connection. In a preferred embodiment, the clamp is used to ground a three-pair aerial drop cable on the terminal or phone pole side of the drop, as well as either the outside network interface (ONI), network interface device (NID) or house side of the drop.

The clamp provides bonding of the cable on the outside of the cable jacket by removing a portion of the jacket from the end of a cable, pulling the shield back over the jacket and then positioning the clamp on the exposed shield. One or more apertures in the side wall of the clamp acts as a peephole or viewing port and allows the shield to be inspected for damage and to ensure that it is electrically contacted by the clamp. A connector on the clamp is tightened to apply pressure to the shield and drop. Preferably, the connector includes a pair of apertures in the opposing walls of the clamp, which are forced together with a fastening device after the cable is inserted in the clamp. In the most preferred embodiments, the fastening device includes a stud, a bolt or a screw and a nut, preferably a nut with a locking washer, a locking nut or a locking washer and a locking nut. When the nut is tightened, a good electrical connection between the clamp and the shield is provided and the clamp is secured to the cable. Attaching the clamp to the cable in this fashion provides superior pull out or cable retention performance compared to prior art devices.

The clamp can also be connected to a jumper cable for connection to a variety of multi-neutral ground locations. In this configuration, the clamp provides an electrical path to bleed off noise. The jumper can also be connected to one or more other jumpers, creating a daisy chain effect to connect a plurality of points. The clamp and the connectors or C-Taps used with the jumpers are preferably made of copper, but other conductive metals can be used.

The connection apertures can also be used to attach the clamp to a jumper cable or wire. The size of the jumper cable/wire can vary depending on the application, but jumpers that use an 8 to 12 gauge stranded cable are preferred, with a 10 gauge stranded jumper cable being most preferred. When more than three multi-pair cables are connected in the same junction box, the secondary jumpers can be connected to the primary jumper by using a "daisy chain" method to connect the jumpers. One such method uses a C-Tap for a #10 stranded cable to connect the primary and secondary jumpers. The size of the C-Tap is selected based on the size of the jumper cable. In addition, other methods of securing the daisy chain can be used, such as Split bolts (seven-X connector) or Fargo style connectors.

The bonding and grounding clamp of the first embodiment of the present invention has a U-shaped construction, with two substantially flat opposing side walls joined at a closed end and open at the other end. Each of the opposing side walls has a top section and a bottom section. The bottom sections are connected by the closed end and the top sections form the open end. The top sections have a connection aperture for connecting the clamp using a fastening device such as a stud, a bolt or a screw in combination with a nut. At least one of the bottom sections has an aperture, which is used to inspect the shield after the clamp is installed on a cable. In a preferred embodiment, the bottom sections and the closed end are formed by a curved side wall in order to more easily accommodate substantially round cables.

In a preferred embodiment, the top and bottom sections are substantially parallel to each other and are connected by an offset section. The offset sections extend inwardly from the bottom sections so that the top sections are closer to each other than the bottom sections. In this embodiment, the cable is secured between the opposing bottom sections and the opposing top sections contact each other when a fastening device is inserted into the connection apertures and tightened.

The clamp can be any size necessary to accommodate the electrical requirements and cable size of the application. Preferably, the clamp is a #10 stud size, but other sizes are contemplated by the present invention and the size of the clamp in no way limits the invention. The dimensions of the offset section, the top and bottom wall sections and the closed end can vary depending on the size of drop in order to provide maximum electrical contact between the clamp and the cable shield. Preferably, the clamp is used with a drop that is rectangular in shape, but oval and round-shaped drops can be accommodated by changing the dimensions and configuration of the wall sections and closed end section. In one embodiment, the bottom wall sections are curved in order to allow the clamp to securely contact round and oval shaped cables.

Connectors, preferably Thomas & Betts Sta-Kon® connectors, are attached to each end of the jumper cables/wires. Connectors that accommodate #10 (i.e., 10 gauge) wire are used in the preferred design, but other sizes of wires and connectors are contemplated by the present invention. Ring, fork (spade) and hook style connectors are preferred for this application but other styles of connectors can be substituted, for example lug or locking fork style.

The second embodiment of the present invention is a bonding and grounding clamp assembly for a shielded cable, preferably, a shielded multi-conductor cable, which optionally, can have an RF (radio frequency) drain wire and, most preferably, a shielded two-pair, three-pair, five-pair or six-pair cable having an RF drain wire. The clamp assembly provides a mechanism for connecting the internal shield of the cable to a ground without damaging the wires inside the cable. Optionally, the clamp assembly can provide a mechanism for bonding an RF drain wire. In a preferred embodiment, the clamp assembly is used to ground a two-pair, three-pair, five-pair or six-pair cable for a buried service wire (BSW). The size of the clamp is adjustable, which allows one clamp to be used with cables having a variety of different sizes and shapes (e.g., flat, round or oval). In another preferred embodiment, the clamp assembly is used to ground a three-pair cable on any housing which is a junction or connecting point from the central office or feeder side of the service, i.e. a pedestal, optical network unit (ONU), terminal, or a remote terminal (RT) site, and on the house side of the drop to a network interface device (NID).

The bonding and grounding clamp assembly includes an annular member and a clamp. The annular member has an annular opening formed by a cylindrical body. A substantially flat leg extends outwardly from the cylindrical body. The clamp has a closed end formed by a substantially circular curved side wall which has opposing ends connected to a pair of substantially flat members that extend outwardly from the side wall. Each of the members has an aperture at approximately the same location. When the annular member and the clamp are assembled, the curved side wall of the clamp substantially surrounds the cylindrical body of the annular member and the members of the clamp are disposed on either side of the leg of the annular member. The opening in the leg of the annular member corresponds to the apertures in the two members of the clamp so that a fastening device, such as a screw, stud or bolt in combination with a nut, can be inserted through the opening and the two apertures to secure the clamp to the annular member.

The clamp assembly provides grounding of the shield of a multi-pair cable in a manner that prevents the wires in the multi-pair cable from being crushed or damaged when the clamp is tightened. The clamp assembly is installed when a cable is terminated by cutting a portion of the jacket or sheath lengthwise at the end of the cable and peeling back the jacket to expose the shield and the pairs of wires. The grounding shield is slit and pulled back to expose the wire pairs. The ends of the wire pairs are then inserted into the opening for the cylindrical body of the annular member and the annular member is slid down over the exposed wire pairs into the open slit, under the cable shield. The pulled-back portion of the shield is replaced over the annular member and wire pairs so that the leg of the annular member extends through the slit made in the grounding shield. The clamp is then positioned over the annular member, preferably after the cable jacket has been replaced over the shield and the annular member. Replacing the jacket protects the shield from damage when the clamp is tightened. When the clamp is installed over the annular member, the flat members of the clamp are disposed on either side of the leg of the annular member and the opening in the leg corresponds with the apertures in the flat embers.

The clamp assembly is typically connected to a grounding cable using a fastening device, which both attaches the grounding cable to the clamp assembly and secures the clamp to the annular member. In preferred embodiments, the fastening device is a stud, a bolt or a screw that is secured by a nut. When the nut is tightened, a good electrical connection between the clamp, the shield and the annular member is provided and the clamp is secured to the grounding cable. Attaching the clamp assembly to the cable shield in this fashion provides superior pull out or cable retention performance compared to prior art devices and prevents the shield from being damaged.

The clamp assembly can also be connected to a jumper cable for connection to a variety of multi-neutral ground locations. In this configuration, the clamp provides an electrical path to bleed off noise. The jumper can also be connected to one or more other jumpers, creating a daisy chain effect to connect a plurality of points. The clamp assembly and the connectors or C-Taps used with the jumpers are preferably made of copper, but other conductive metals can be used.

The annular member is installed between the grounding shield and the one or more pairs of wire so that the pairs of wires pass through the annular opening. The clamp is installed over the grounding shield so that the curved side wall of the clamp corresponds to the exterior wall of the annular member and the opening in the substantially flat leg corresponds to the pair of apertures in the pair of substantially flat members. A fastening device can be inserted in the opening in the substantially flat leg and the pair of apertures in the pair of substantially flat members so that when the fastening device is tightened, the grounding shield is electrically contacted by the annular member and the clamp.

The bonding and grounding clamp assembly can be any size necessary to accommodate the electrical requirements and cable size of the application. Preferred embodiments of the bonding and grounding clamp assembly are for cables containing two pairs, three pairs, five pairs, or six pairs of wires. The dimensions of the annular member and the clamp can vary depending on the number of pairs of wire in the cable in order to provide maximum electrical contact between the clamp and the cable shield. Various size annular members and clamps are contemplated by the present invention and the size of the annular member and clamp in no way limits the invention.

Connectors, preferably Thomas & Betts Sta-Kon® connectors, are attached to each end of the grounding or jumper cables/wires. Connectors that accommodate #10 (i.e., 10 gauge) wire are used in the preferred design, but other sizes of wires and connectors are contemplated by the present invention. Ring, fork (spade) and hook style connectors are preferred for this application but other styles of connectors can be substituted, for example lug or locking fork style.

Looking now at the accompanying drawings, FIGS. 1-10 show the first embodiment of the present invention and FIGS. 11-14 show the second embodiment. FIG. 1 shows a front view of a preferred embodiment of the bonding and grounding clamp 10. The clamp 10 includes a closed end 12 connected to a pair side walls 11, 13 (see FIG. 2) each having a bottom section 14, 16 (see FIG. 2) connected by an offset section 24, 26 (see FIG. 2) to a top section 18, 20 (see FIG. 2). Opposite the closed end 12 of the clamp 10 is an open end 22 formed by the two side walls 11, 13. The bottom sections 14, 16 of the side walls 11, 13 have apertures 15, 17 (see FIG. 2), which are used to inspect the shield 54 (see FIG. 5) of a cable inserted into the clamp 10 (see FIG. 6). The top sections 18, 20 have connection apertures 19, 21 (see FIG. 2), which can receive a stud, bolt or screw 40 (see FIG. 3) that is used to tighten and secure the clamp 10.

Figure 2:
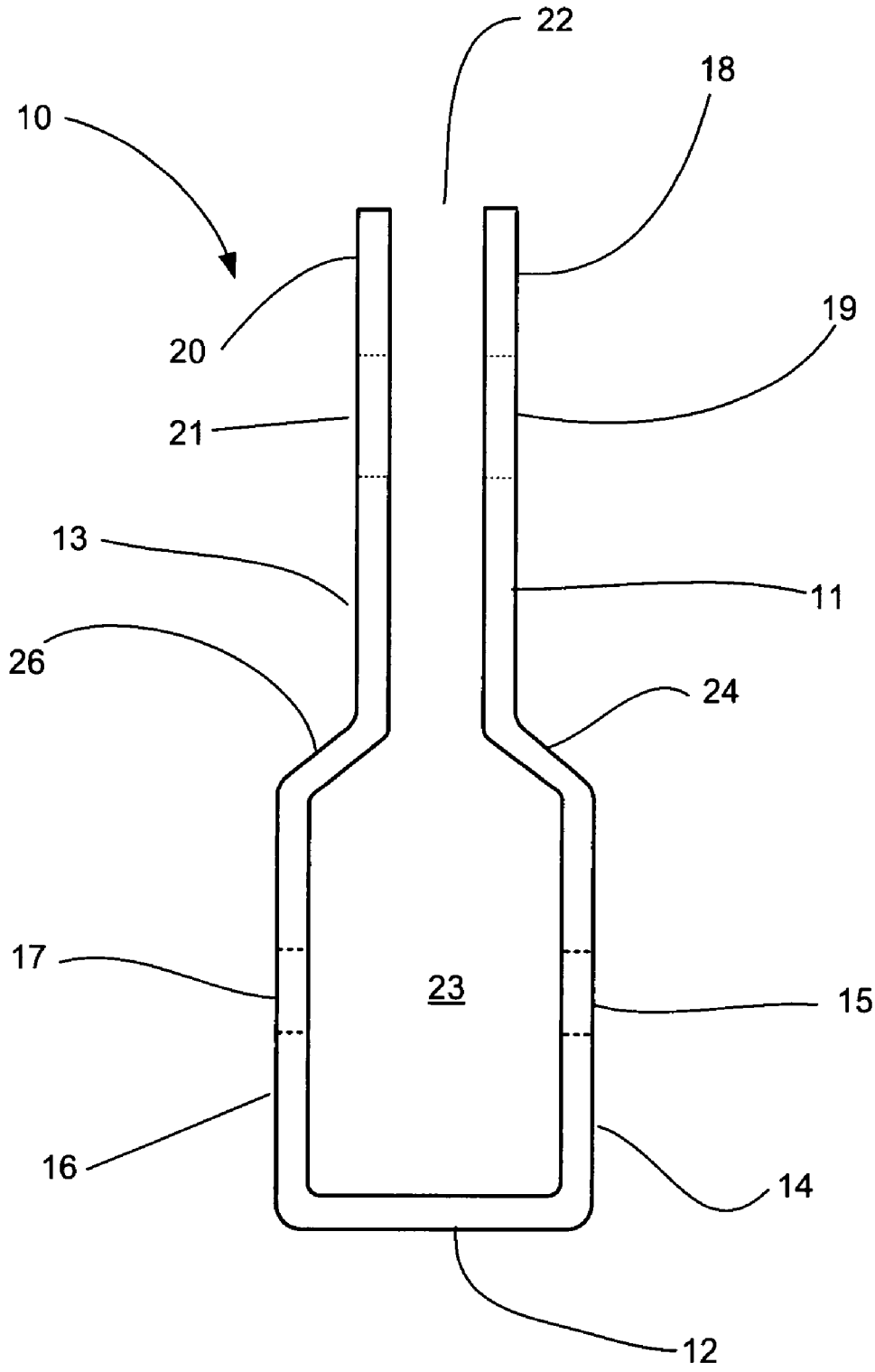
FIG. 2 is a side view of the first embodiment of the bonding and grounding clamp.
Figure 5:
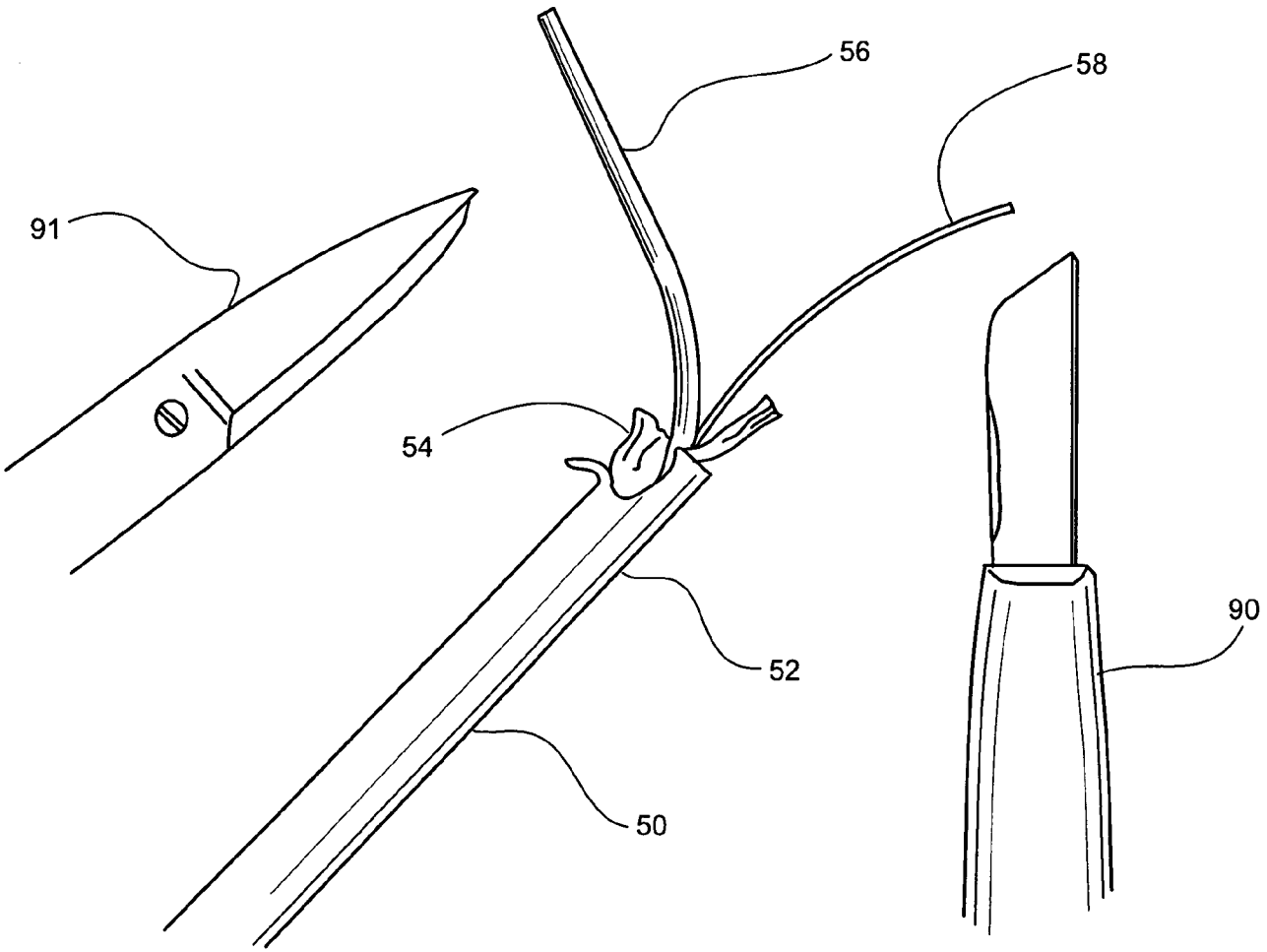
FIG. 5 shows the end of a multi-pair cable with approximately 2 to 3 inches of the jacket removed and the shield folded back.
Figure 6:
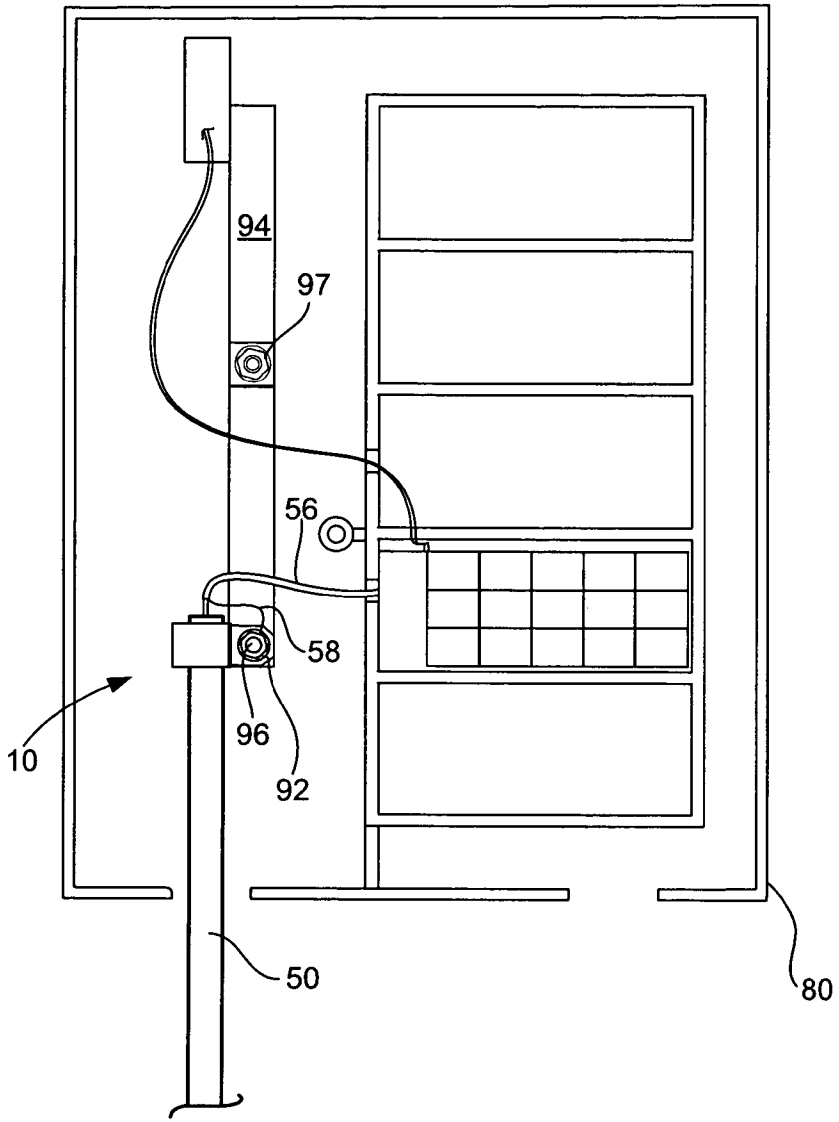
FIG. 6 shows a multi-pair cable connected to a network interface device with a bonding and grounding clamp of the first embodiment.

FIG. 2 shows a side view of the clamp 10 with a rectangular opening 23 for receiving a cable 50 (see FIG. 6). The cable 50 is placed between the bottom sections 14, 16 of the side walls 11, 13 after the jacket 52 is removed from the end of the cable 50 and the shield 54 is folded back over the jacket 52 (see FIG. 5). The top sections 18, 20 of the clamp 10 are then joined together to secure the cable 50 in the clamp 10.

Figure 3:
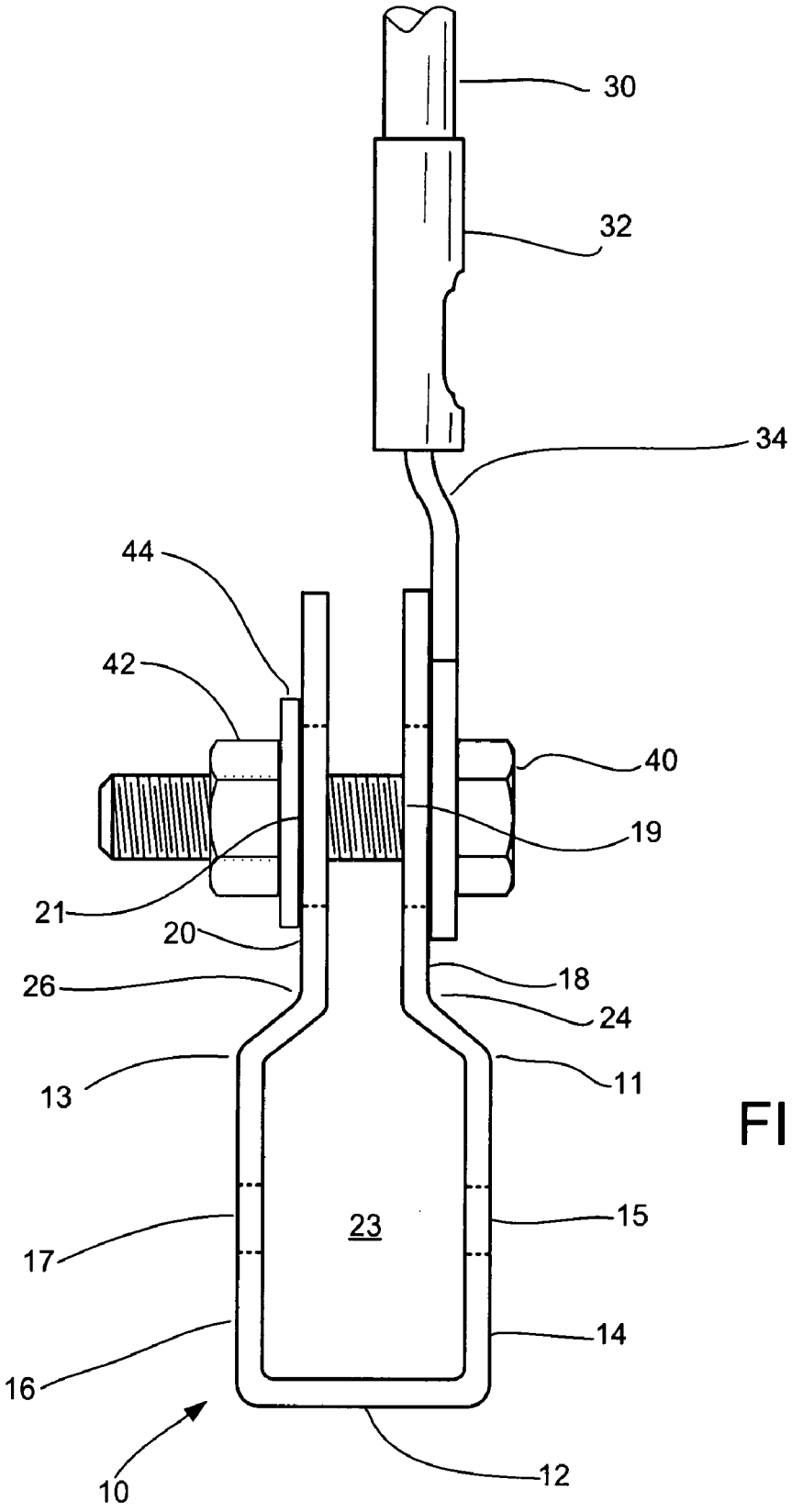
FIG. 3 a side view of the first embodiment of the bonding and grounding clamp connected to a jumper cable with a nut and bolt.

FIG. 3 shows a side view of the clamp 10 connected to a jumper cable 30 with a nut 42, washer 44 and screw 40. After a cable 50 (see FIG. 5) is inserted in the opening of the clamp 23, the RF drain wire is wrapped around the screw 40 and the nut 42 is tightened to secure the cable 50 in the clamp 10 and the RF drain wire to the clamp. The cable has a ring connector 34 with a compression fitting 32 for attaching the connector 34 to the jumper cable 30.

Figure 4:
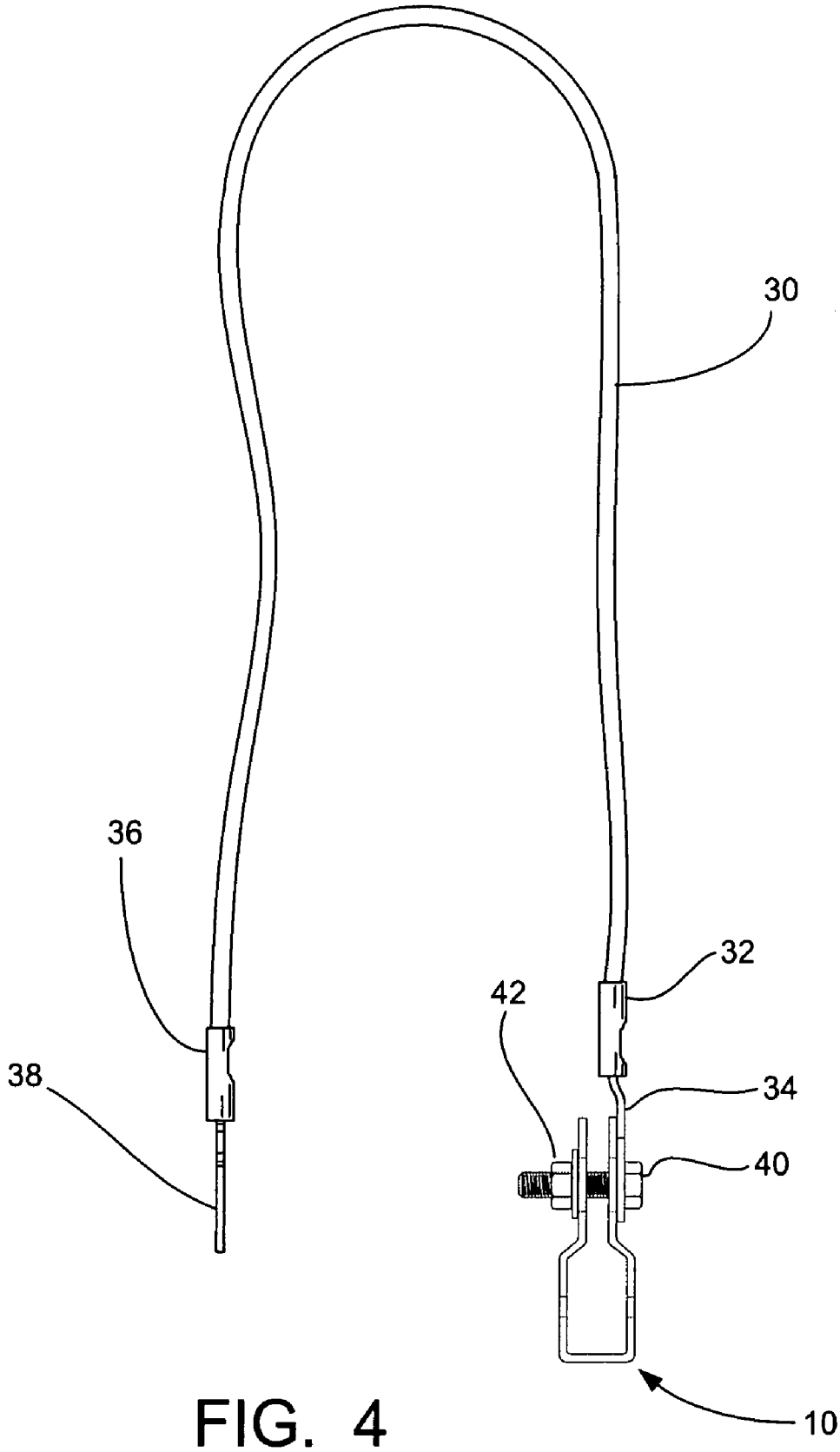
FIG. 4 is a side view of the first embodiment of the bonding and grounding clamp and jumper cable assembly.

FIG. 4 is a side view of the clamp 10 and jumper cable 30. The clamp 10 is connected to the jumper 30 on one end with a ring connector 34 and a spade connector 38 is attached to the other end of the jumper 30 with a compression fitting 36. The length and gauge of the jumper cable 30 is determined by the application.

FIGS. 5-10 show the preparation of the cable and the installation of the first embodiment of the bonding and grounding clamp. These figures are discussed in more detail in the examples below.

Figure 11:
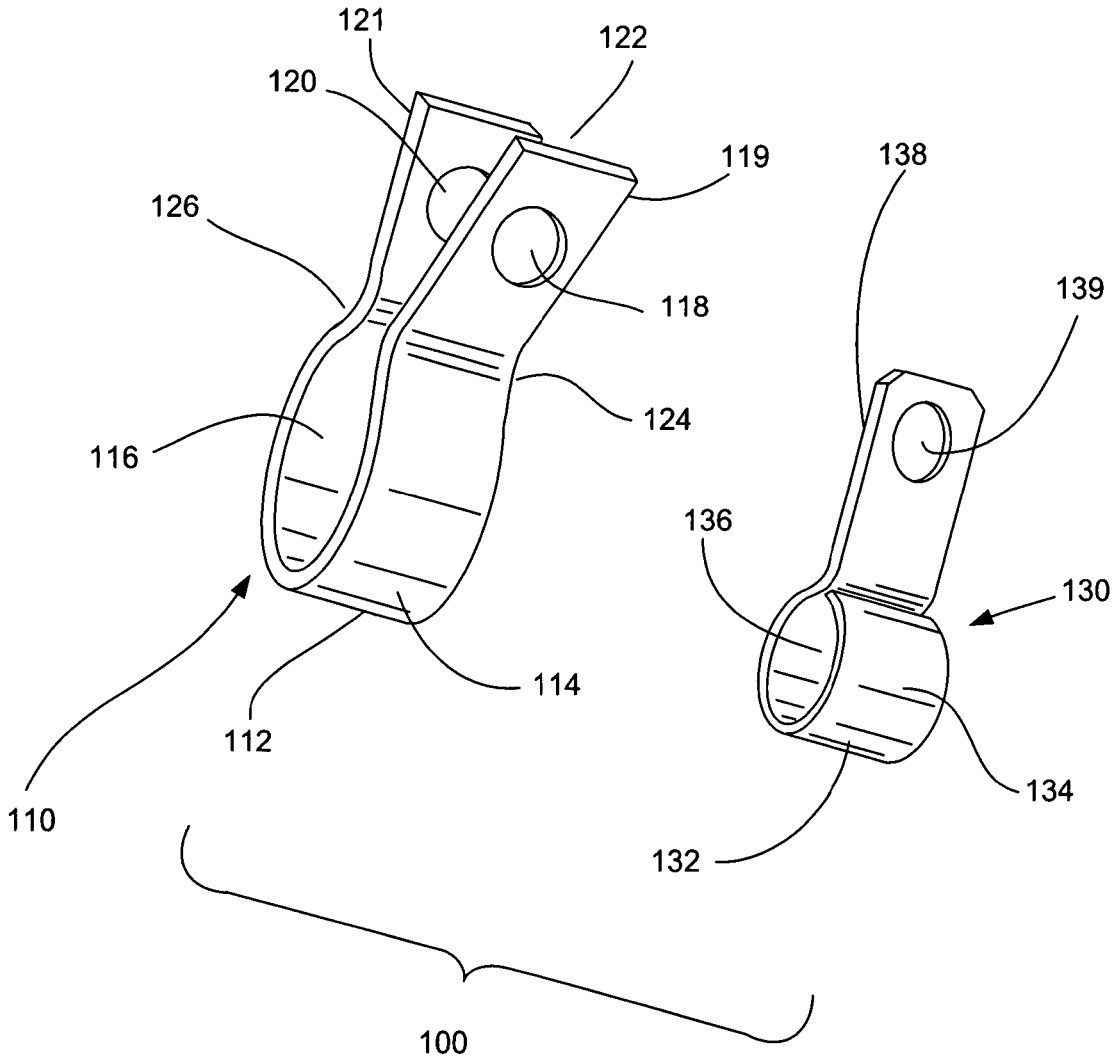
FIG. 11 shows the bonding and grounding clamp assembly of the second embodiment which includes the annular member and the clamp.

FIG. 11 shows a preferred embodiment of the second embodiment of the bonding and grounding clamp assembly, which includes an annular member 130 and a clamp 110. The annular member 130 has a cylindrical body 132, an exterior wall 134, and an annular opening 136. A substantially flat leg 138 extends outwardly from the exterior wall 134, substantially perpendicular to the longitudinal axis of the annular member 130. The leg 138 has a substantially round opening 139 for receiving a screw 140 (see FIG. 12). The clamp 110 includes a closed end 112 having a curved side wall 114 with opposing ends 124, 126 and a pair of substantially flat members 119, 121 which extend outwardly from the opposing ends 124, 126. The substantially flat members 119, 121 define an open end 122 and each of the substantially flat members 119, 121 includes an aperture 118, 120.

Figure 12:
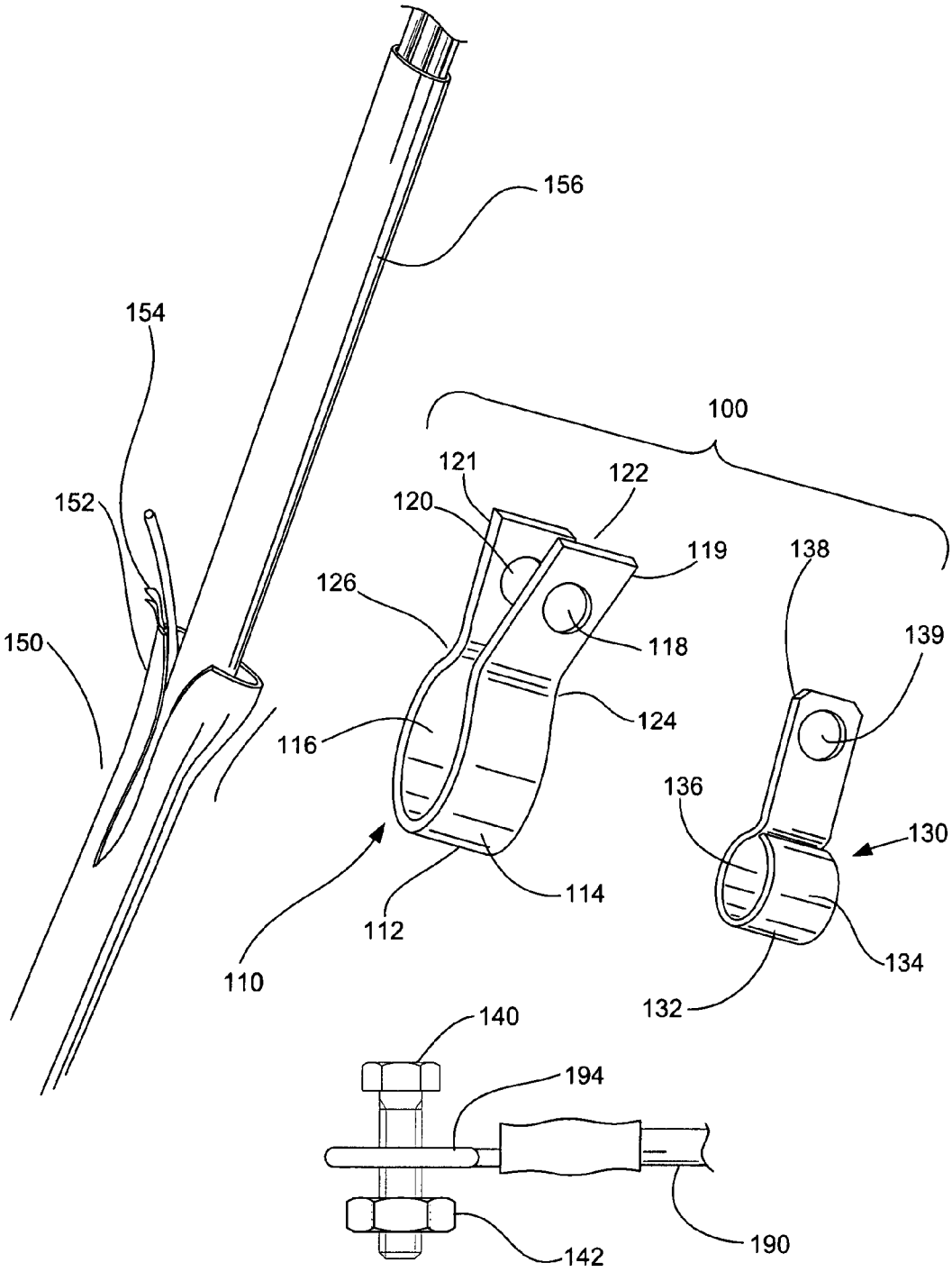
FIG. 12 shows the bonding and grounding clamp assembly of the second embodiment prior to installation on a cable containing multiple pairs of wires.

FIG. 12 shows the bonding and grounding clamp assembly 100 prior to installation on a cable 150 containing multiple pairs of wires 156. When the cable 150 is terminated, the cable jacket 152 and the shield 154 are cut and, preferably, between about 5 and 10 inches are removed to uncover the pairs of wires 156. Slits, extending from about ½ inch to about 1 inch (depending on the size of the cable and the size of the clamp) from the end of the cable 150, are then made in the cable jacket 152 and shield 154 and the cable jacket 152 and shield 154 are carefully pulled back so that they are not damaged. The exposed pairs of wire 156 are then inserted into the annular opening 136 and the annular member 130 is positioned on the cable 150. The shield 154 and jacket 152 are then folded back over the exterior wall 134 of the annular member 130 so that the leg 138 extends through the slit in the jacket 152 and the slit in the shield 154. The clamp 110 is then placed over the jacket 152, the shield 154 and the annular member 130 so that the apertures 119, 121 in the members 118, 120 of the clamp 110 correspond with the opening 139 in the leg 138, which is disposed between and contacts the members 118, 120.

Figure 13:
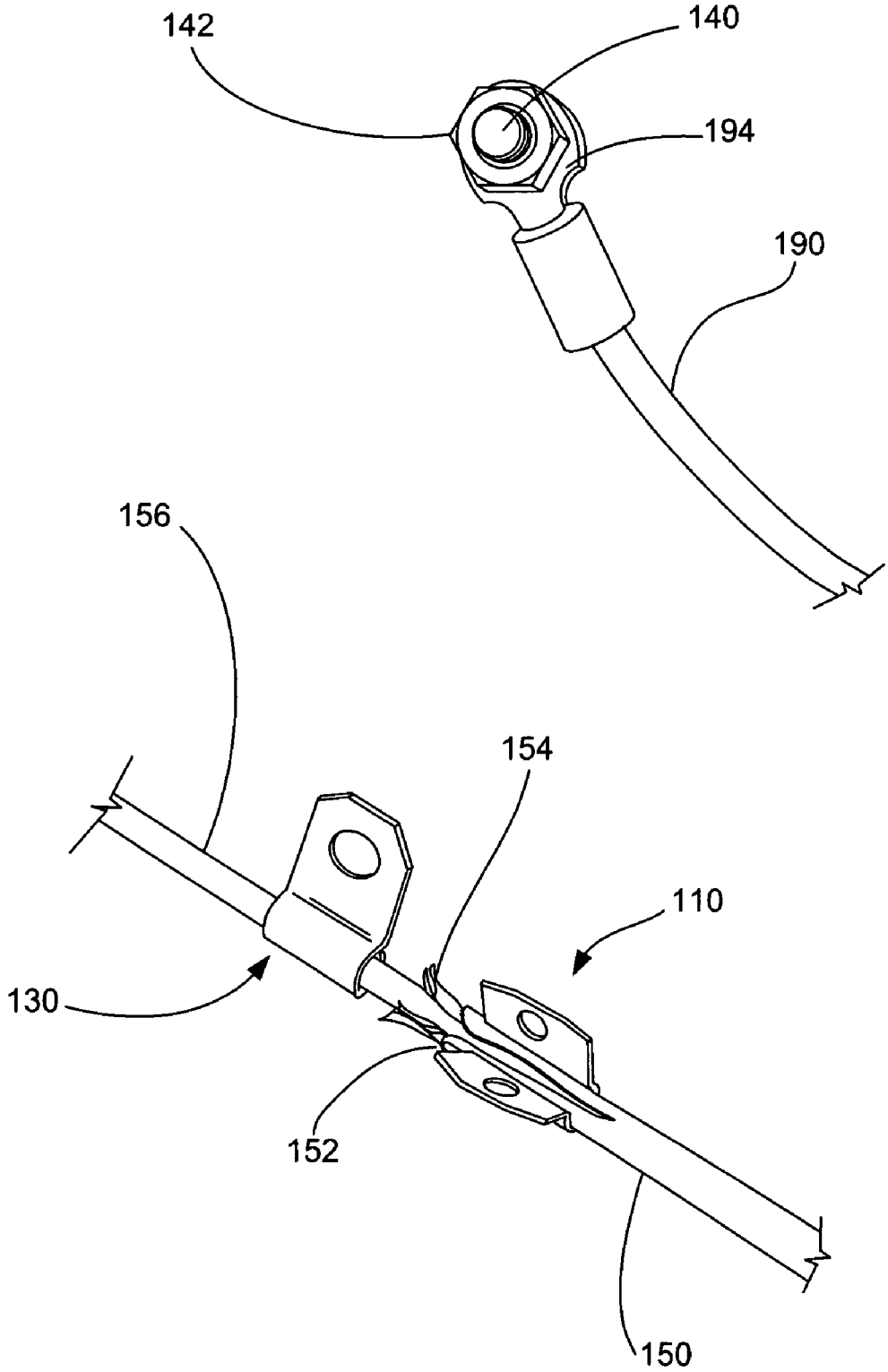
FIG. 13 shows the bonding and grounding clamp assembly of the second embodiment after the annular member is installed and before the clamp and grounding cable are connected.

FIG. 13 shows the annular member 130 installed on the wire pairs 156 before the cable shield 154 and cable jacket 152 are folded over onto the cylindrical body 132. The clamp 110 is in a position where it is being moved down the cable 150 and onto the annular member 130. Positioning the jacket between the shield 154 and the annular member 130 and the clamp 110 protects the shield 154 from being damaged when the clamp 110 is tightened around the annular member 130. After the clamp 110 is mated to the annular member 130, the grounding cable 190 can be attached to the clamp assembly 100 using the lug connector 194 and a screw 140 and nut 142.

Figure 14:
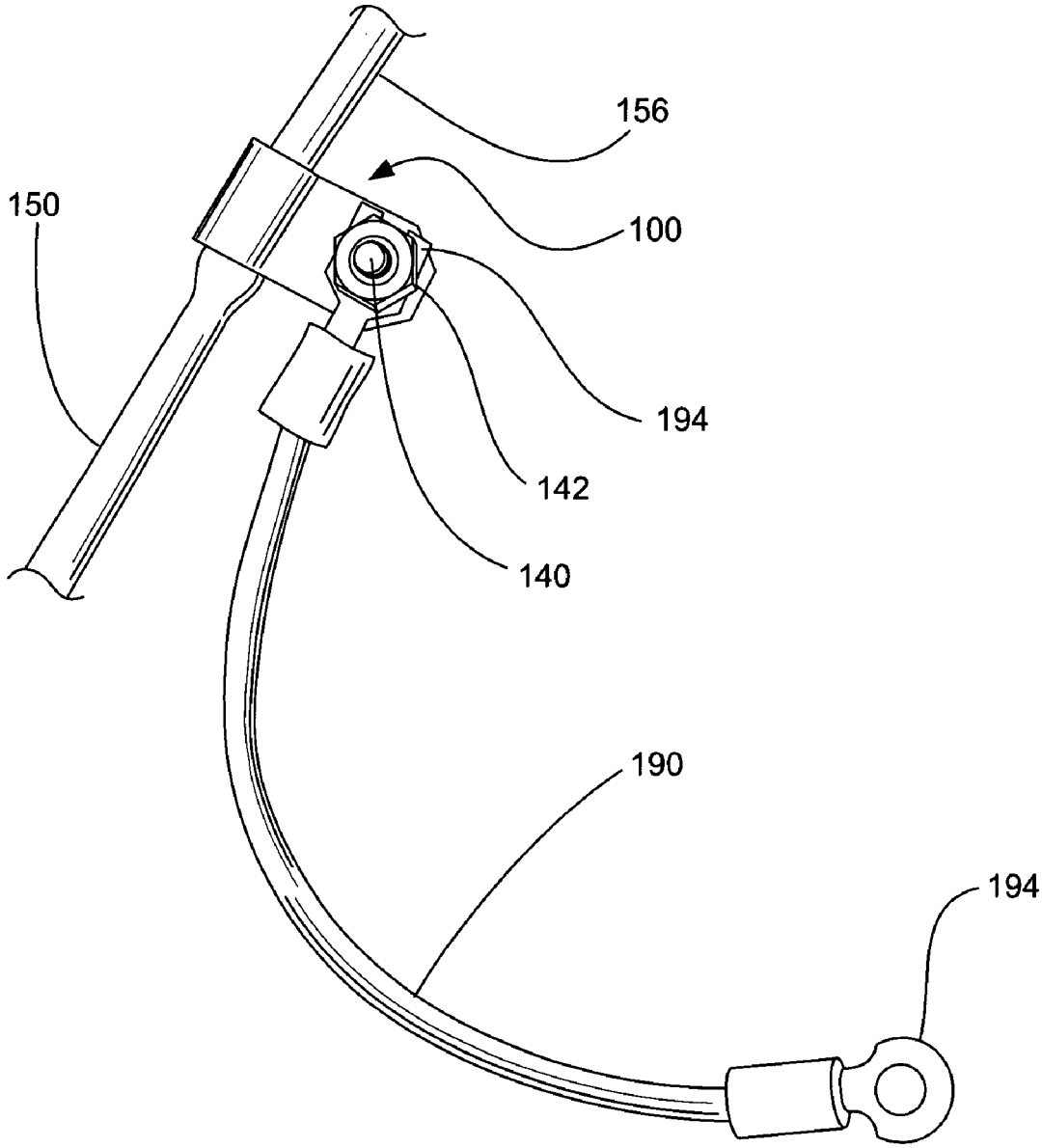
FIG. 14 shows the bonding and grounding clamp assembly of the second embodiment connected to a jumper cable with a nut and bolt.

FIG. 14 shows how a grounding cable 190 with a lug connector 194 at the end is attached to the bonding and grounding clamp assembly 100 using a screw 140 and a nut 142. The screw 140 is inserted sequentially in the lug connector 194, the aperture 118 in the first member 119, the opening 139 in the leg 138 and then the aperture 120 in the second member 121 (see FIG. 11). The nut 142 is threaded onto the screw 140 and tightened to mechanically and electrically secure the grounding clamp assembly 100 to the shield 154 (see FIG. 13) and the grounding cable 190.

EXAMPLES

The clamp of the present invention can be used to bond the shield and RF drain wire of a cable to a terminal in a junction box on a utility pole as well as to a terminal in a Network Interface Device (NID) on the user side, such as a home or business. The examples set forth below serve to provide further appreciation of the invention but are not meant in any way to restrict the scope of the invention.

Example 1

This example describes one method of installing the first embodiment of the wire bonding and grounding clamp. As shown in FIG. 5, the cable jacket 52 of a multi-pair cable 50 is removed using a knife 90 or scissors 91, without cutting or damaging the pairs of wires 56, the internal cable shield 54 and the drain wire 58. Preferably, about 2 to 3 inches of the jacket 52 are removed as shown in FIG. 5. The shield 54 is then carefully pulled down over the outside of the cable jacket 52, making sure not to tear it.

The prepared end of the cable 50 is placed in the NID 80 as shown in FIG. 6. The exposed wire pairs 56 and drain wire 58 are inserted through the clamp 10 and the clamp 10 is positioned over the folded-back shield 54 and jacketed portion 52 of the cable 50. The clamp 10 is secured to the bond bar 94 by inserting the bond bar post 96 through the clamp's 10 mounting/connection aperture 19 (see FIG. 1) and tightening a nut 92 onto the bond bar post 96. Before the nut 92 is completely tightened, the RF drain wire 58 is placed between the clamp 10 and the nut 92 and twisted around the post 96. The nut 92 is then tightened to secure and electrically contact the clamp 10 and drain wire 58 to the bond bar 96. If more than one drop is required in the NID 80, additional clamps (not shown) can be installed using the same procedure to secure cables to another bond bar stud 97 in the NID 80.

Example 2

In this example, the clamp 10 of the present invention is installed in a junction box 82 and a jumper cable 30 is connected to the clamp 10. The length of the jumper cable 30 depends on the location of the termination points and for most applications either an 18" or the 36" jumper can accommodate the distance required. The jumper cable 30 is provided with connectors 34, 38 on the two ends, preferably ring and/or spade (i.e., fork) connectors.

Figure 7:
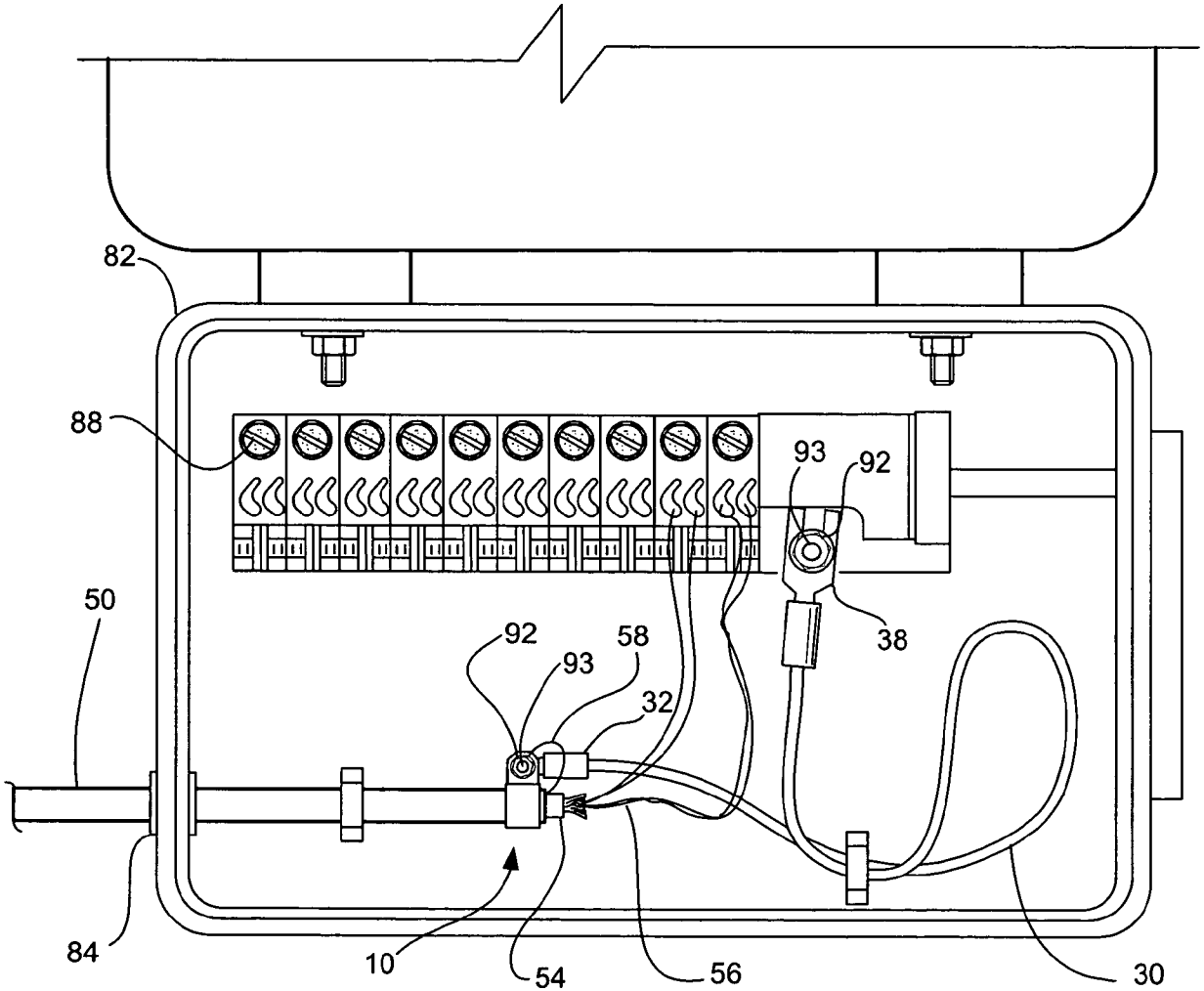
FIG. 7 shows a multi-pair cable connected to a junction box with a bonding and grounding clamp of the first embodiment.

The end of a multi-pair cable 50 is prepared in the manner described in Example 1, with the shield 54 folded-back over the cable jacket 52 (see FIG. 5). Before the clamp 10 is attached to the cable 50, the prepared end of the cable is inserted through a grommet 84 in the bottom of the junction box 82 as shown in FIG. 7. The cable 50 is then inserted into the clamp 10 until the clamp 10 contacts the shield 54 that is folded-back over the cable jacket 52. The clamp 10 is positioned over the prepared cable jacket 52 so that the shield 54 is visible through the inspection aperture 15 (see FIG. 1) in the wall 11 of the clamp 10. The mounting stud 93 (also referred to herein as a grounding stud) in the junction box 82 is then inserted through the connection apertures 19, 21 (see FIGS. 1 and 2) of the clamp 10 and the RF drain wire 58 is wrapped around the stud 93. One end of the jumper 30 is attached to a ring connector 34, which is placed over the stud 93 and contacts the drain wire 58. The nut 92 is tightened to secure the clamp 10, the drain wire 58 and the ring connector 34 (see FIG. 4) in place. The other end of the jumper 30 has a spade connector 38, which is connected to the grounding stud 93 on the terminal block 88. This is accomplished by loosening the nut 42 on the grounding stud 93, inserting the spade connector 38 under the nut 92 and tightening the nut 92.

Example 3

Figure 8:
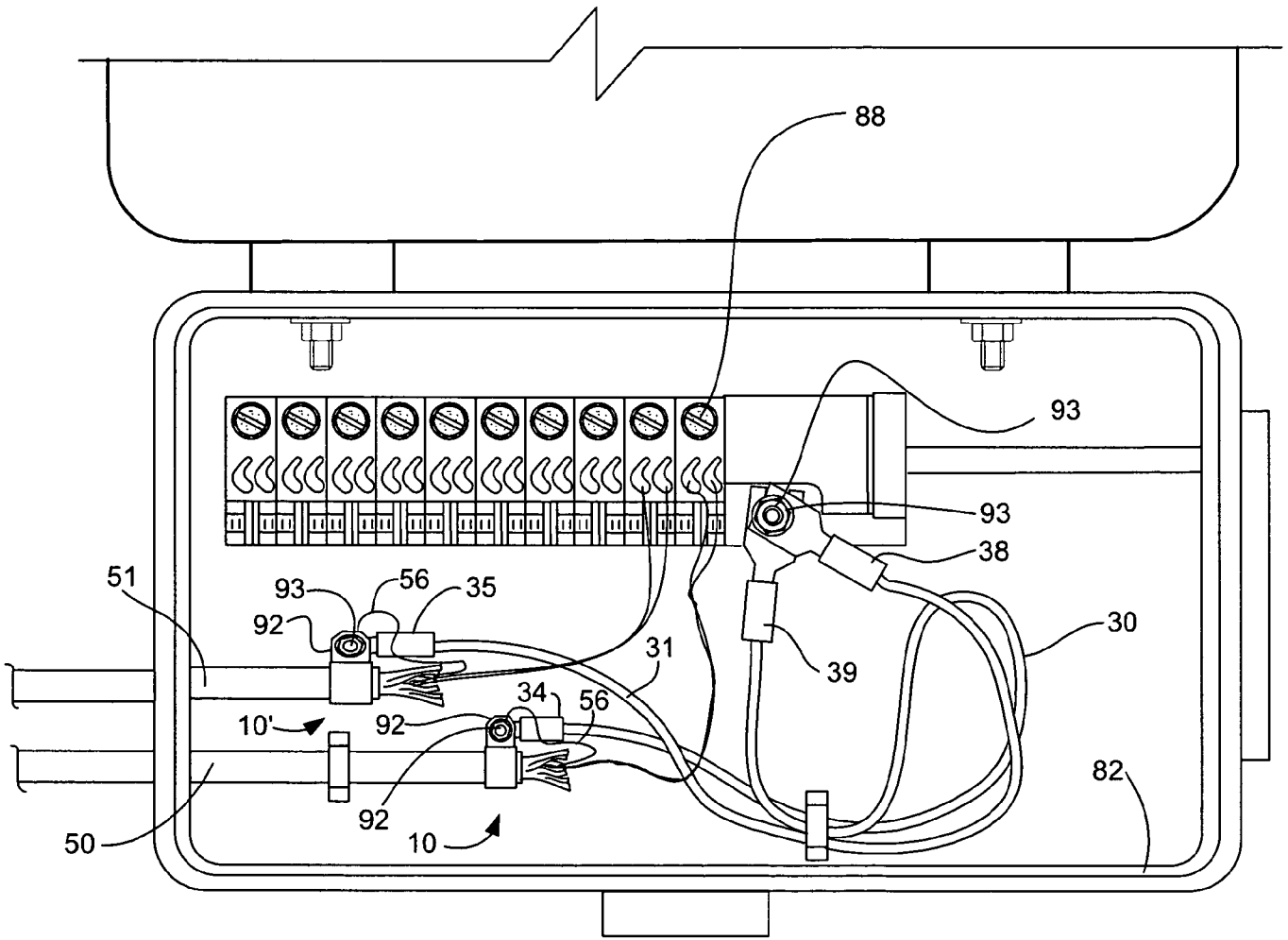
FIG. 8 shows two multi-pair cables connected to a junction box with two bonding and grounding clamps of the first embodiment.

When additional multi-pair cables 51 are connected in the junction box 82, the same procedure described in Example 2 is used. FIG. 8 shows how the spade connectors 38, 39 for the jumper cables 30, 31 are stacked on the grounding stud 93 of the terminal block 88 and secured in place by tightening the grounding stud nut 92. The other ends of the jumpers 30, 31 are connected to the grounding clamps 10, 10' by ring connectors 34, 35 and secured by grounding stud nuts 92.

Example 4

When more than 3 or 4 drops are installed on the same terminal block 88, the grounding stud 93 may not be long enough to accommodate all of the spade connectors of the jumper cables. In this example, a daisy chain method is used to connect the jumpers to the primary jumper cable 30.

Figure 9:
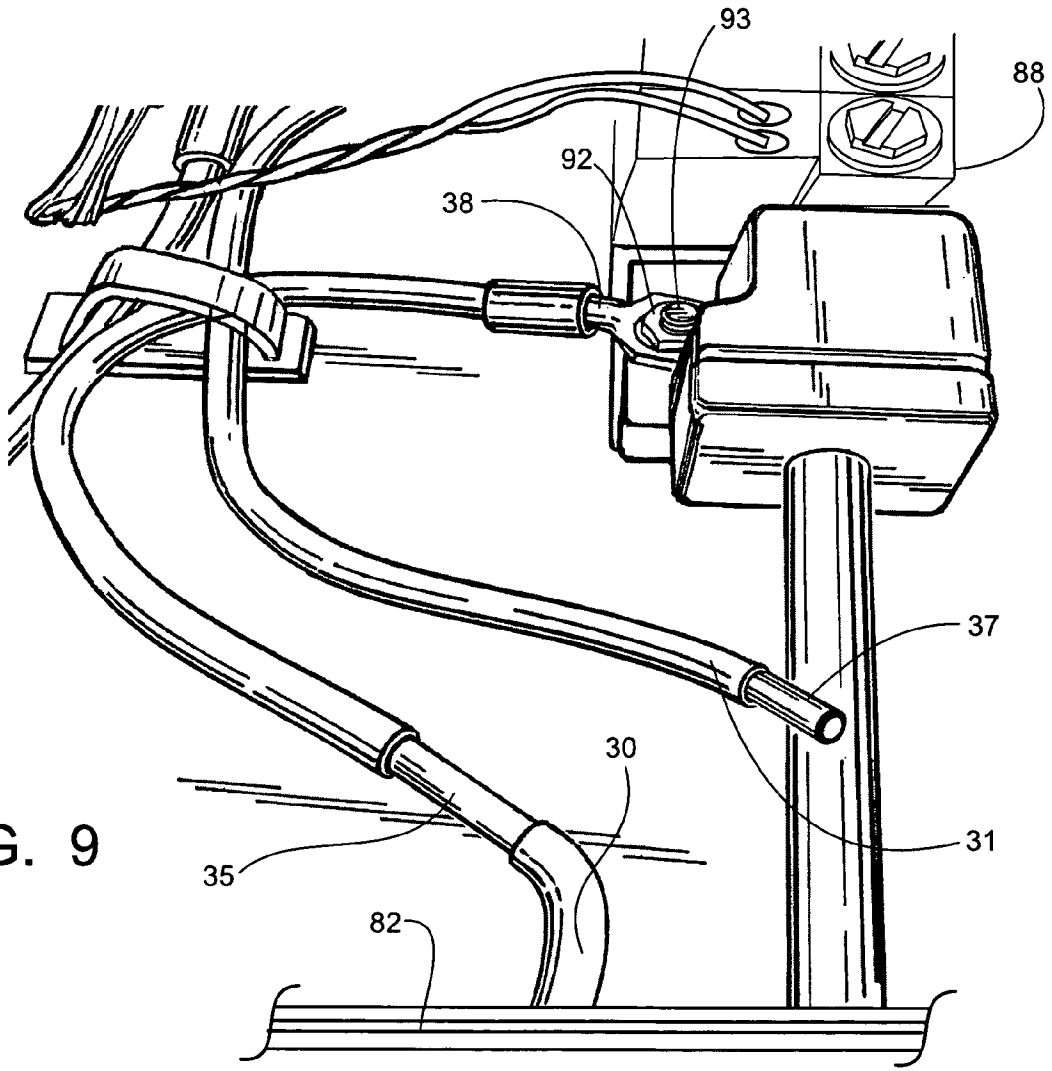
FIG. 9 shows a primary jumper cable with a section of the jacket removed and a secondary jumper cable with one end stripped.
Figure 10:
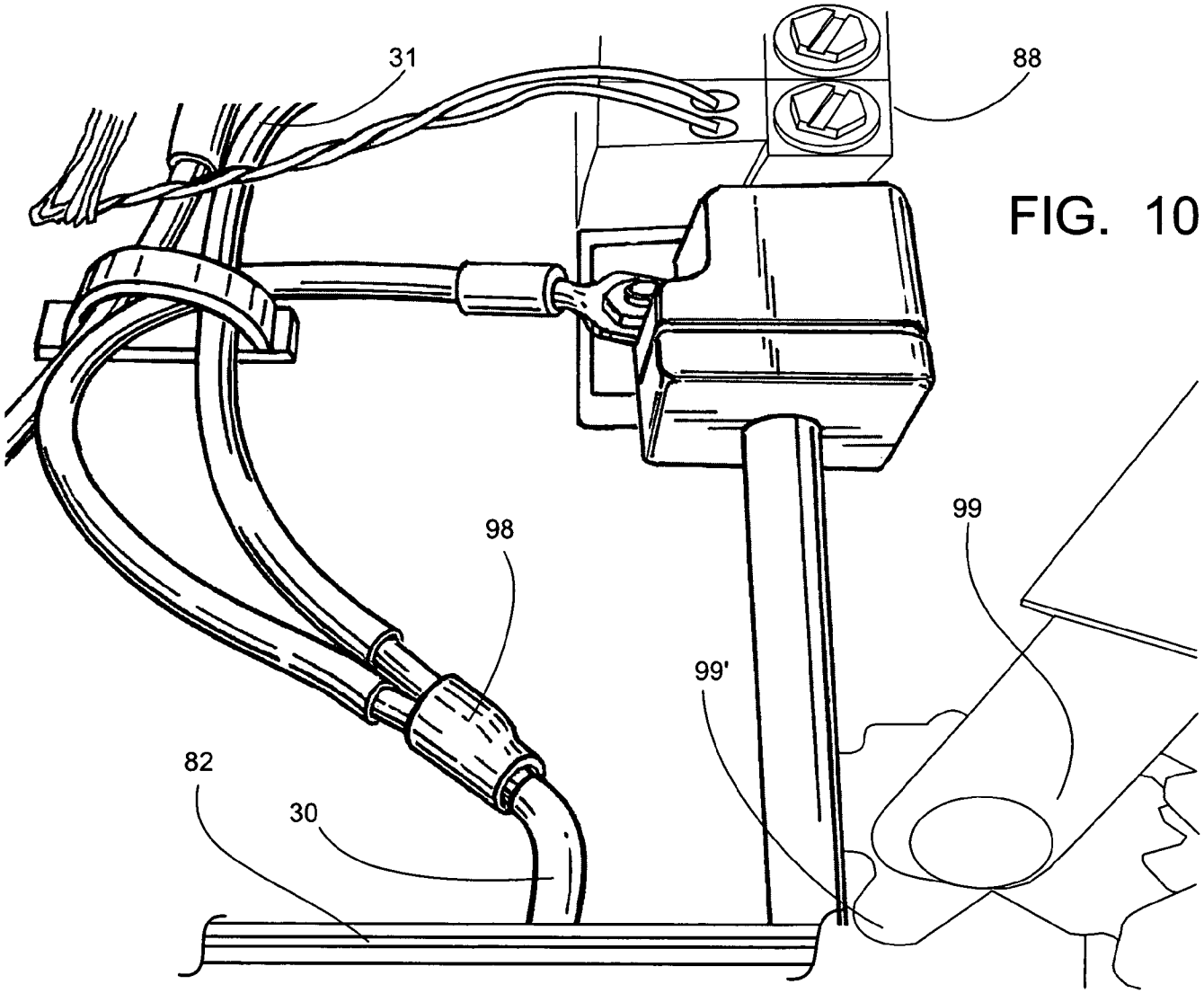
FIG. 10 shows the primary and secondary jumper cables of FIG. 9 connected using a connector.

The ends of the multi-pair cables (not shown) are prepared as described in Example 1 and connected to studs (not shown) in the junction box 82 as described in Example 2. The jumper cables 30, 31 are then installed using a daisy chain method as shown in FIGS. 9 and 10. First, the insulation is stripped from about a one half inch portion 35 of the primary jumper cable 30 in a location that is easily accessible and free of other wires. The spade connector on a secondary jumper 31 for one of the other drops is then cut off and about one-half inch of the insulation is stripped from the end 37. The secondary jumper 31 should be long enough so that it can easily reach the stripped section 35 of the main jumper 30, as shown in FIG. 9.

The secondary jumper 31 is then electrically connected to the primary jumper 30 using any of a variety of methods well known to skilled electrical technicians. In a preferred method shown in FIG. 10, a Blue C-tap 98 and a TBM21E compression tool 99 are used to join the secondary jumper 31 to the primary jumper 30. The dies 99' on the compression tool 99 are color coded and the blue die is selected on the TBM21E to insure a proper compression fitting 98 is formed. Two compressions are required to secure the Blue C-Tap. In another preferred method, a Fargo style connector is used.

When the terminal is not protected or does not have a bonding stud, the clamp must be bonded to the best multi neutral ground that is available. In order to provide proper grounding, each end of a drop must have the shield 54 and the RF drain wire 58 bonded to a path to ground.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A cable bonding and grounding clamp comprising:

a closed end having a first side and a second side;

a pair of side walls each having a first section connected to a second section by an offset section, wherein one of the first sections extends from the first side of the closed end and the other first section extends from the second side of the closed end, wherein the first and second sections are substantially flat and substantially parallel to each other, and wherein the second sections are offset inwardly from the first sections by the offset sections;

an open end formed by the second sections;

an aperture in at least one of the first sections for viewing a cable positioned between the first sections; and an opening in each of the second sections.

2. The cable bonding and grounding clamp according to claim 1, further comprising a fastening device that passes through the openings in the substantially flat sections.

3. The cable bonding and grounding clamp according to claim 2, wherein the fastening device comprises a threaded bolt or screw and a nut.

4. The cable bonding and grounding clamp according to claim 2, wherein the fastening device is tightened to secure the cable between the two first sections of the side walls and to electrically contact the two second sections.

5. The cable bonding and grounding clamp according to claim 1, wherein the first sections of the side walls are separated by a first distance and the second sections of the side walls are separated by a second distance, and wherein the first distance is from about 0.25 to about 4 times greater than the second distance.

6. The cable bonding and grounding clamp according to claim 1, wherein each of the first sections has an aperture.

7. The cable bonding and grounding clamp according to claim 1, wherein the openings in the second sections are substantially aligned.

8. The cable bonding and grounding clamp according to claim 1, wherein the first sections of the side walls form a clamp opening therebetween, and wherein a cable having a maximum cross-sectional dimension of up to about 3 inches can pass through the clamp opening.

9. The cable bonding and grounding clamp according to claim 1, wherein the clamp is made from an electrically conductive metal.

* * * * *